US006394935B1

(12) United States Patent
Lake

(10) Patent No.: US 6,394,935 B1
(45) Date of Patent: May 28, 2002

(54) THERAPEUTIC EXERCISE APPARATUS

(75) Inventor: Chester M. Lake, Ontario (CA)

(73) Assignee: Intra-Med Industries, Inc., Concord (CA)

( * ) Notice: Subject to any disclaimer, the term of this patent is extended or adjusted under 35 U.S.C. 154(b) by 28 days.

(21) Appl. No.: 09/653,731

(22) Filed: Sep. 1, 2000

Related U.S. Application Data

(60) Provisional application No. 60/152,716, filed on Sep. 7, 1999, and provisional application No. 60/152,765, filed on Sep. 3, 1999.

(51) Int. Cl.[7] ..... A63B 21/06
(52) U.S. Cl. ..... 482/94; 482/93; 482/98
(58) Field of Search ..... 482/120, 139, 482/98–103, 904, 93

(56) References Cited

U.S. PATENT DOCUMENTS 403,703 A * 5/1889 Small ..... 482/94
457,400 A * 8/1891 Dowd ..... 482/94
723,625 A * 3/1903 Thornley ..... 482/94
931,699 A * 8/1909 Medart ..... 482/94
4,154,441 A 5/1979 Gajda
4,402,504 A * 9/1983 Christian ..... 482/94
4,549,733 A * 10/1985 Salyer ..... 482/94

* cited by examiner

*Primary Examiner*—Jerome Donnelly
(74) *Attorney, Agent, or Firm*—Blodgett & Blodgett, P.C.

(57) ABSTRACT

A therapeutic exercise apparatus having a weight and pulley system mounted on a supporting frame. The pulley system includes upper and lower pulley blocks slidably mounted on a vertical post. Either of the pulley blocks can be releasably fixed to the post. The pulley blocks and weight are connected to a cord and pulley system so that when one pulley block is fixed to the post and the other pulley block is free to slide on the post, the free pulley block moves toward the fixed pulley block and the weight is lifted when the end of a cord at the free pulley block is pulled forwardly.

7 Claims, 9 Drawing Sheets

THERAPEUTIC EXERCISE APPARATUS

CROSS-REFERENCE TO RELATED APPLICATIONS

This application claims the benefit under 35 U.S.C. §119 (e) of prior U.S. Provisional Application Nos. 60/152,716 filed Sep. 7, 1999 and 60/152,765 filed Sep. 3, 1999 all of which are hereby incorporated by reference.

BACKGROUND OF THE INVENTION

The present invention relates to a therapeutic exercise apparatus which utilizes variable weight which are lifted through a pulley system which includes multiple sheaves.

Traditional weight and pulley exercise devices have been employed for therapeutic purposes. These exercise devices are designed primarily for weight training and toning by relatively fit or healthy individuals. These devices are adjustable with respect to the amount of weight resistance to accommodate individuals at all fitness or strength levels. However, these devices are inadequate for persons who are recovering from an injury or have a disability who otherwise require physical therapy. Even if a traditional exercise device is set at a low level it may be to harsh for an individual requiring therapeutic exercise. In some cases, traditional exercise devices can actually cause physical damage rather than assist in the rehabilitation of a patient.

It is, therefore, a primary object of the present invention to provide an exercise device which is specifically designed for therapeutic rehabilitation of a patient.

Another object of the invention is to provide a physical therapeutic exercise device which is adjustable for a wide range of conditions requiring therapy or rehabilitation.

A further object of the invention is the provision of a physical therapeutic exercise device which can accommodate individuals at essentially all levels of physical fitness.

A still further object of the invention is the provision of the physical therapeutic device which can also be used for conforming to body movements normally encountered in everyday activities including sports activities.

With these and other objects in view, as will be apparent to those skilled in the art, the invention resides in the combination of parts set forth in the specification covered by the claims appended hereto.

SUMMARY OF THE INVENTION

A therapeutic exercise apparatus having a weight and pulley system mounted on a supporting frame. The pulley system includes upper and lower pulley blocks slidably mounted on a vertical post. Either of the pulley blocks can be releasably fixed to the post. The pulley blocks and weight are connected to a cord and pulley system so that when one pulley block is fixed to the post and the other pulley block is free to slide on the post, the free pulley block moves toward the fixed pulley block and the weight is lifted when the end of a cord at the free pulley block is pulled forwardly. In another embodiment of the invention, each of the pulley blocks can be fixed in a plurality of positions on the post. With both pulley blocks fixed on the post, the cord can be pulled forwardly from either pulley block or both.

BRIEF DESCRIPTION OF THE DRAWINGS

The invention is illustrated in the accompanying drawings in which.

DETAILED DESCRIPTION OF THE INVENTION

Figure 1:
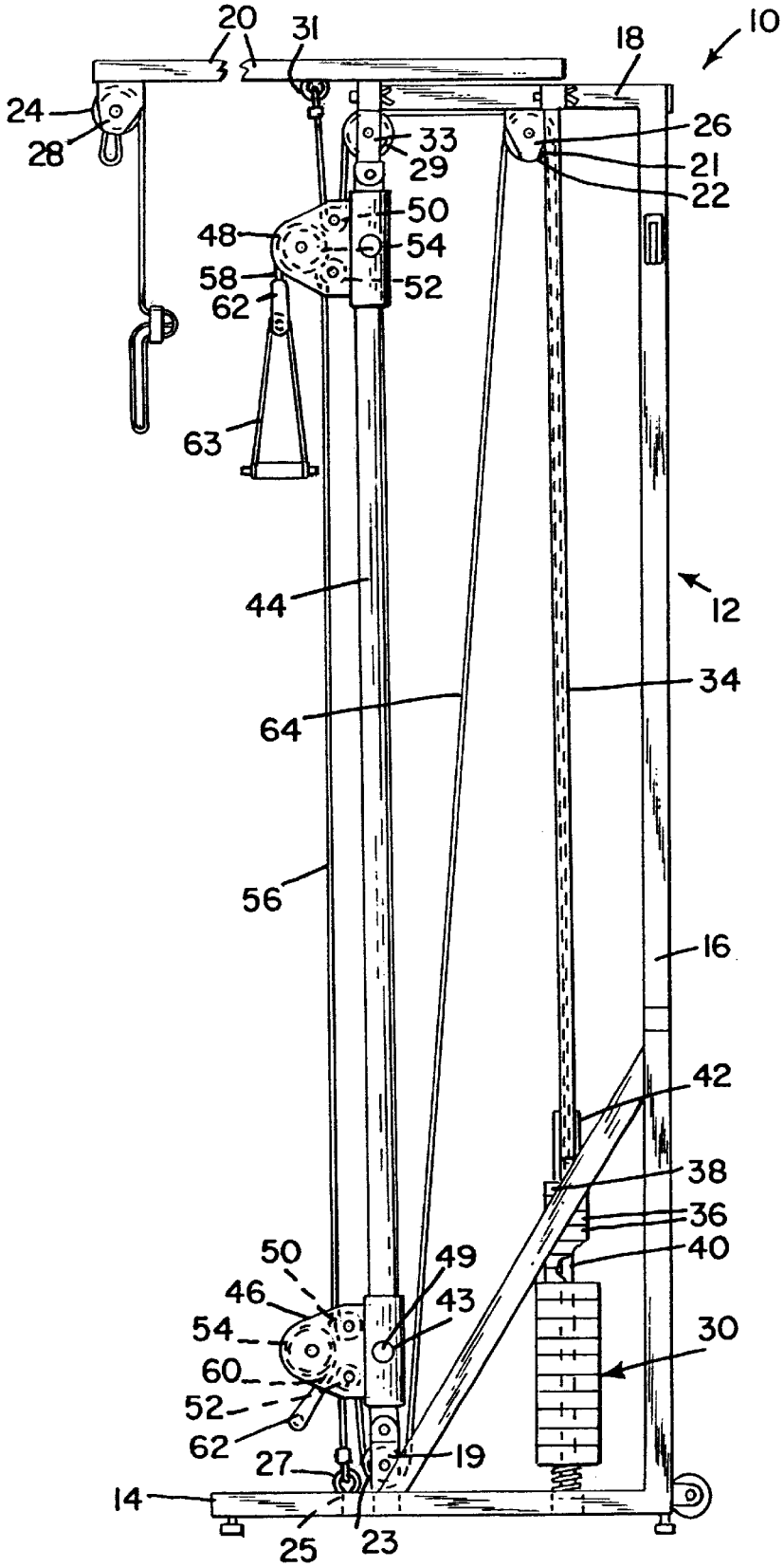
FIG. 1 is a side elevational view of the therapeutic exercise apparatus.
Figure 2:
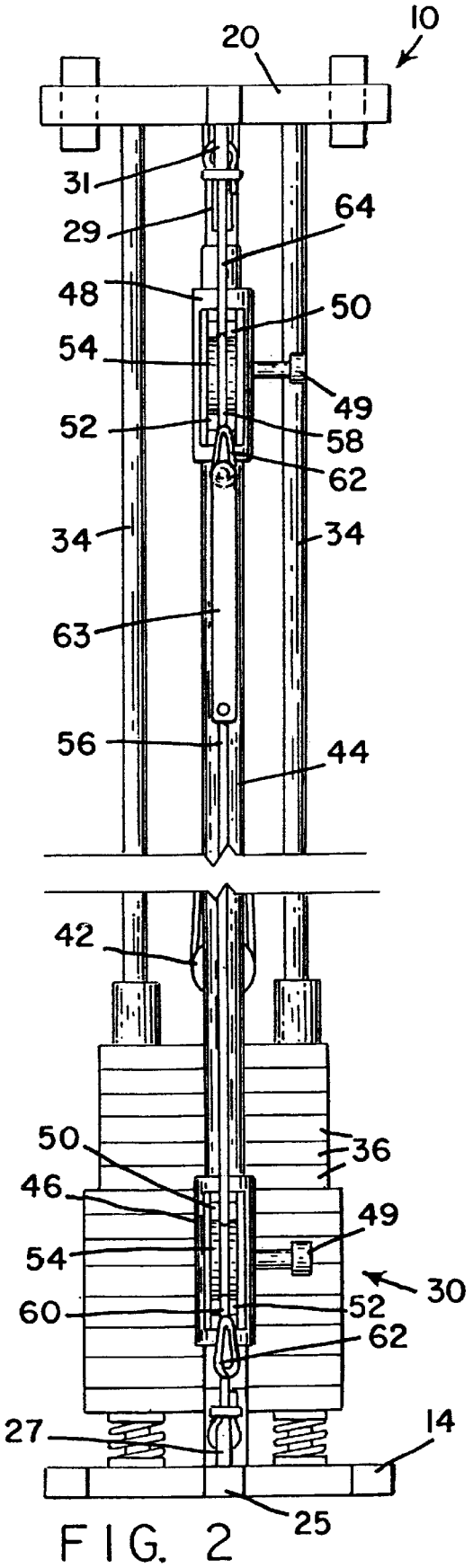
FIG. 2 is a fragmentary front elevational view of the apparatus of FIG. 1.

Referring to FIGS. 1 and 2, there is shown a therapeutic exercise assembly, generally indicated by the reference numeral 10. The assembly 10 is a continuously variable position pulley system (C.V.P.P.) which includes a frame, generally indicated by the reference numeral 12, having a supporting base 14, a pair of vertical back posts 16, a pair of upper horizontal bars 18 extending from the upper ends of the back posts 16, and an intermediate horizontal bar 20 supported by the bars 18 and extending in cantilever fashion forwardly of the bars 18.

A pair of guide pulleys 21 and 22 are rotatably mounted between a pair of spaced brackets 26 fixed to the rearward end of the bars 18 and a sheave 24 are rotatably mounted between a pair of spaced brackets 28 which is fixed to the forward end of the bar 20. An eye-hook 27 is fixed to a bracket 25 which is, in turn, fixed to the base 14. An eye hook 31 is fixed to the bar 20. A lower forward guide pulley 23 is mounted for rotation between a pair of spaced brackets 19 which are fixed to lower end of the forward post 44 and the base 14.

The frame 12 supports a weight stack, generally indicated by the reference numeral 30. The weight stack 30 includes a pair of vertical rods 34 extending upwardly from the supporting base 14. A plurality of weight bars 36 are slidably mounted on the rods 34. An upper block 38 is also slidably mounted on the rods 34 above the stack of weight bars 36. A vertical rod 40 extends downwardly from the upper block 38 between the spaced vertical rods 34, see FIG. 1. Each weight bar 36 has a vertical aperture near each end of the plate for receiving the rods 34 and a central vertical aperture for receiving the rod 40. The weight stack 30 is of conventional construction. Each weight bar 36 has a horizontal aperture. The rod 40 has a plurality of horizontal apertures. When the upper block 38 is in its lowest position, as shown in FIG. 2, the apertures of the rod 40 are aligned with the apertures of the individual weight bars 36. Any one of the weight bar can be connected to the rod 40 by inserting a locking pin through the aperture of a selected weight bar and a corresponding aperture of the rod 40. When the upper block 38 is moved upwardly, the weight bar 36 which is locked to the rod 40 will move upwardly with the rod along with all of the weight bars which are located above the selected weight bar. A weight sheave 42 is rotatably connected to the upper portion of the upper block 38.

A forward vertical post 44 is fixed to the frame 12 and extends from the base 14 to the horizontal bars 18. A lower pulley block 46 and an upper pulley block 48 are slidable mounted on the forward post 44. The post 44 has a lower horizontal aperture 43 and an upper horizontal aperture, not shown. Each pulley block 46 and 48 has a horizontal aperture which is aligned with the post 44. When the lower pulley block 46 is moved to its lowest position, as shown in FIG. 2, its horizontal aperture is aligned with the lower aperture 43. The lower pulley block 46 can be locked at this lower position by a locking pin 49. The upper block 48 is shown in FIG. 1 in its upper position wherein, its horizontal aperture is aligned with the upper horizontal aperture in the forward post 44. Each pulley block 46 and 48 has an upper sheave 50, a lower sheave 52, and an intermediate forward sheave 54. Each of the sheaves 50, 52, and 54 are mounted for rotation within its respective pulley block.

An upper sheave 29 is mounted for rotation between a pair of spaced brackets 33 which are connected to the upper end of the forward post 44 and the intermediate horizontal bar 20.

A short forward cord 56 has a first end 58 and a second end 60. A latch hook 62 is fixed to each end 58 and 60 of the cord 56. The hooks 62 can be connected together when the apparatus 10 is not being used. One or both of the latch hooks 62 can be connected to a hand grip such as the grip 63 shown in FIG. 1.

The cord 56 extends from the end 60 into the pulley block 46 between the forward sheave 54 and the sheave 50. The cord 56 extends upwardly from the lower pulley block 46 to the upper pulley block 48. The cord 56 extends through the upper pulley block 48 between the forward sheave 54 and the sheave 52 to the end 58.

The hooks 62 are sufficiently large to prevent the ends of the cord 56 from being pulled through the pulley blocks 46 and 48. When one of the pulley blocks 46 and 48 is fixed to the forward post 44, the hook 62 at the end of the cord 56 at the pulley block which is fixed functions as an anchor for that end of the cord. This allows the hook 62 to be attached to the hand grip or handle 63 for pulling of the other and of the cord 56 from the pulley block which is not fixed.

A long rearward cord 64 has a lower end which is fixed to the hook 27 and an upper end which is fixed to the eye hock 31. The cord 64 extends from the eye hook 27 into the pulley block 46 around the sheave 52 and downwardly to the lower forward guide pulley 23. The cord 64 extends upwardly from the guide pulley 23 to the guide pulley 21 and downwardly from the guide pulley 21 to the weight sheave 42. The cord 64 extends upwardly from the weight sheave 42 to the guide pulley 22 and forwardly to the top of the guide pulley 29. The cord 64 then extends downwardly from the guide pulley 29 to the pulley block 48, under the sheave 50 and upwardly to the hook 31.

Figure 18:
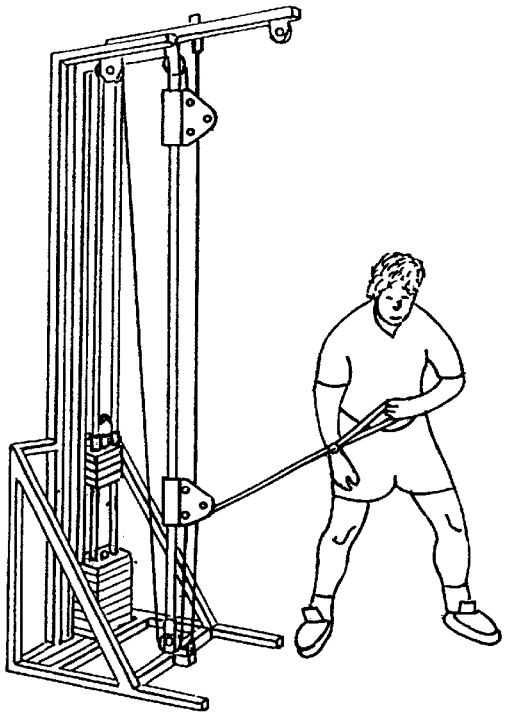
Figure 19:
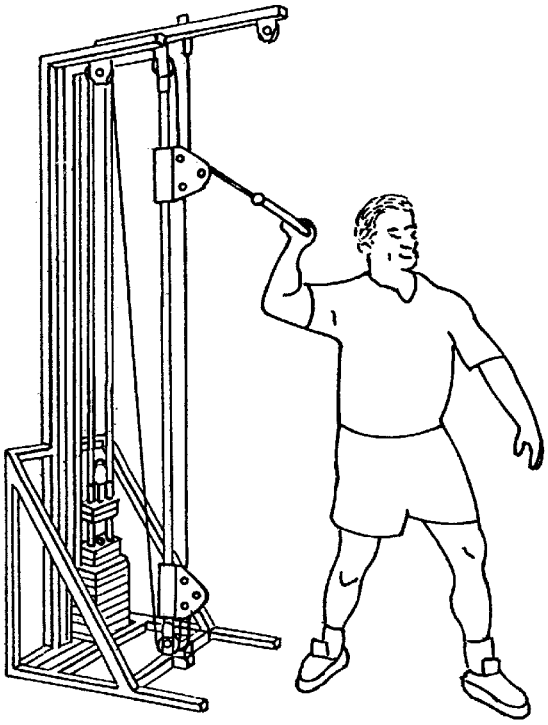
Figure 20:
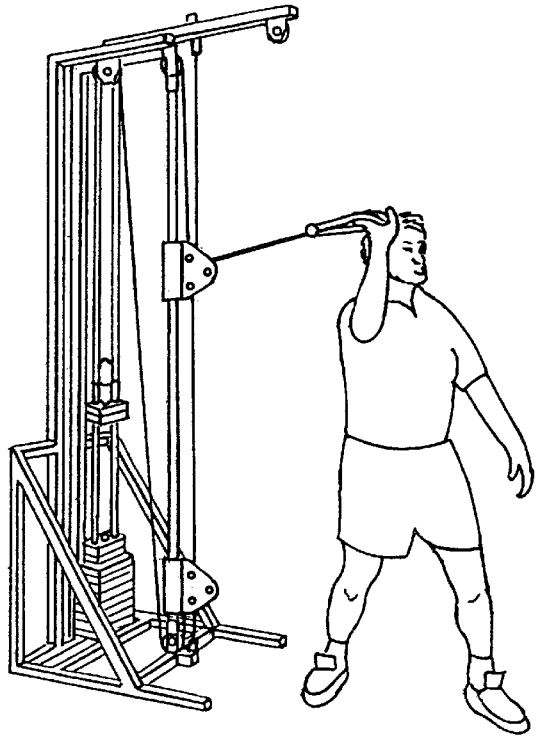

The assembly 10 can be used in any one of several modes. In one mode, the lower pulley block 46 is fixed to the forward post 44 by one of the pins 49 while the upper pulley block 48 is allowed to slide freely on the post 44, see FIGS. 19 and 20. In a second mode, the upper pulley block 48 is fixed to the forward post 44 by one of the locking pins 49 and the lower pulley block 46 is allowed to slide on the forward post 44, see FIG. 18. In a third mode, each of the pulley blocks 46 and 48 is allowed to slide on the forward post 44. Either of the pulley blocks 46 and 48 will slide on the forward post 44 if it is not fixed to the post 44 and the adjacent end of the cord 56 is pulled forwardly away from the pulley block. Vertical movement of one of the pulley blocks along the forward post 44 causes the cord 64 to be extended from either sheave 23 or sheave 29 toward the center of forward post 44 which, in turn, causes the weight sheave 42 and a selected number of weight bars 30 to be lifted by the cord 64. If neither of the pulley blocks 46 and 48 are fixed to the forward post 44. Pulley blocks 46 and 48 will slide along the forward post 44 toward each other when both cord ends 58 and 60 are pulled forwardly by the user of the apparatus 10. Movement of the pulley blocks 46 and 48 will effectively cause a selected number of weight bars 30 to be lifted by the cord 64.

Figure 3:
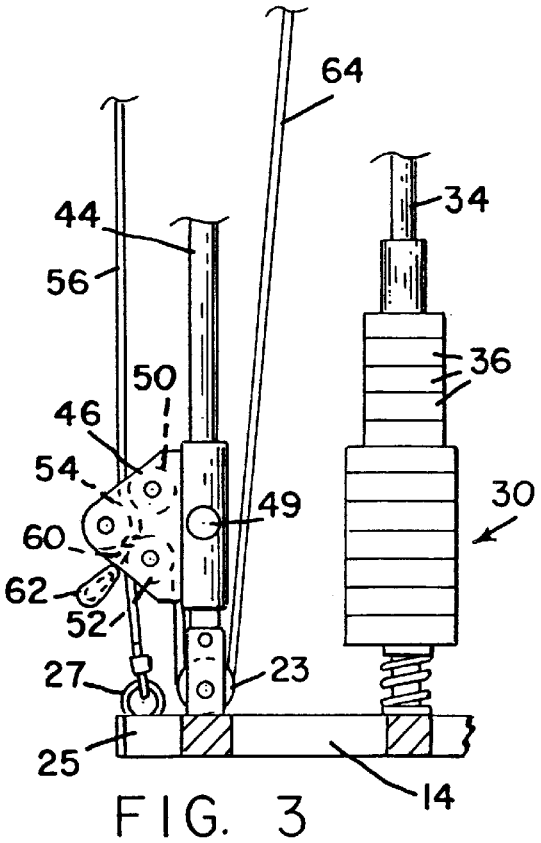
FIG. 3 is a fragmentary front elevational view of one of the pulley blocks of FIG. 1.

Referring to FIGS. 1–3, the significant difference between a fixed pulley device and the device of the present invention is the coordinated sliding of the pulley block 46 and 48 on the forward post 44 with the pulling on cord end 58 and 60 with suitable grips or attachments. The movement of the pulley blocks 46 and 48 allows the angle of the cord ends 58 and 60 to remain more optimally oriented with the extremity being exercised. This is particularly important with exercises that require a large arc of motion with the extremity as with unilateral asymmetric Proprioceptive Neuromuscular Facilitation (PNF) exercise. In these exercises, an extremity is caused to move across the midline of body in a sweeping arc motion. These motions are beneficial because the mimic typical work and sports motions and are very hard to do with fixed pulley systems. With fixed pulley systems, the angle of the cord with respect to the extremity varies as the exercise is conducted. This variance of angle is due to the fact that as the arc of these movements progresses, the extremity rotates away, changing its angle with respect to the forward post by 180 degrees or more. The pulley system of the present invention on the other hand, accommodate this change in angle by allowing one or both of the pulley blocks 46 and 48 to move along the forward post 44 as the arc of the extremity motion proceeds. As long as the plane of the arc of the motion of the extremity remains parallel with the plane formed by the cords 58 and 60 and the forward post, the angle of the cord 58 and 60, representing the line of force of the external load, remains nearly normal to the extremity at the point of attachment of the cord 58 and 60 to the extremity with grip or strap or other means. This changing of the pulley position keeps the angle of the cord ends 58 and 60 more consistent with respect to the extremity and therefore more representative to typical external loads applied during work or sports. It is important in the strengthening process especially as part of recovery after injury, not to overload the injured muscle, ligament or tendon or joint by misdirecting the externally applied loads. The optimum loading direction is normal or perpendicular to the long axis of the extremity to which the cord 58 and 60 is fastened at the point of attachment. This is because the therapist or user of the system can more carefully judge the force being applied to the extremity when the angle is consistent.

If the angle of the applied exercise loads varies, the direction of the load on the joint varies. In addition, as the load direction varies, the target muscles of the exercise change inappropriately and the intended exercise loses affectivity. Using fixed pulley systems, there is no ability to maintain a consistent angle or optimum angle of the external load being applied through the handgrip and cord relative to the extremity as it moves through its arc. The fixed pulley systems therefore have reduced effectiveness and safety of the many large arc exercises. In summary, the fixed pulley system may produce inappropriate and unpredictable results, including injury. The pulley system of the present invention, when properly used, reduces the uncertainty of the applied load by maintaining an more controllable and predictable angle between the cord 58 and 60 and the extremity during its arc of motion around its joint system. Not all exercises use or require this unique capability. Many exercises are best done using the fixed pulley arrangement, however pulley system of the present invention accommodates this by fixing the pulley blocks 46 and 48 with the locking pins 49 on the forward post 44.

The advantages and capabilities of the exercise assembly 10 are described more fully below in reference to FIGS. 5–24.

The pulley blocks 46 and 48 of assembly 10 move continuously with the pulling of the handles 62 and 63. Thus, the resistance cord gives more resistance torque at most angles and resists through a wider arc of motion. This is particularly important for wide-sweeping PNF motions and many sports movements. The unit may be mounted on the wall or on a stand.

Figure 6:
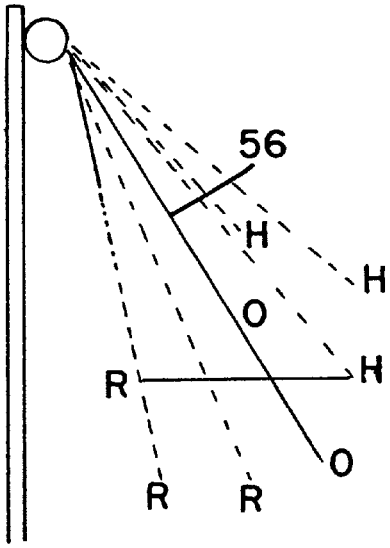

Assembly 10 provides resistance over a wider arc of motion than the standard pulley systems. FIG. 6 shows the cord and pulley action rotating around an axis on a fixed pulley system. The fixed pulley system resists the segment for half a complete circle and helps for half a circle since the direction of the cord remains constant at any single point. R-indicates points where the pulley cord resisting its movement in a counter clockwise direction. O-indicates points where the pulling 56 cord offers no resistance to the segment (i.e. The force is either distracting of compressing the segment.) H-indicates points where the cord 56 would be helping the segment turn counter clockwise.

Figure 7:
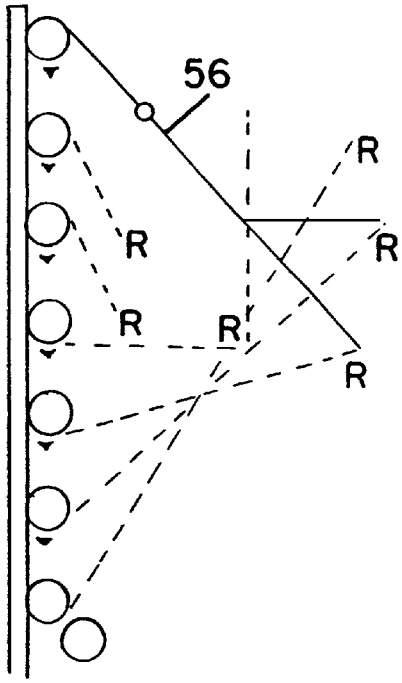

FIG. 7 shows the relationship between the cord and pulley of assembly 10. In this relationship there is resistance in a full circle. As the segment moves, the pulley block moves so that the direction of the cord pull changes as the segment moves. As shown, the resistance points cover ¾ of a circle on assembly 10 as opposed to ½ of the circle on a fixed pulley system. The pulling cord 56 forms a greater angle with the moving segment at most points in the arc of motion. In all resistive(R) points except when the cord is perpendicular to the segment, the cord 56 is at a greater angle to the segment. Thus, the movement arm for the resistance is greater at each R point for the system of the present invention. This makes any resistance force attached to the cord more effective at providing resistance torque at each R point.

R-indicates where the pulley cord is resisting the segment. O-indicates where the cord's force is neither resisting or helping. H-indicates where the pulley cord is helping move the segment.

The pulley system of apparatus 10 resists large sweeping movement over a wider arc of motion and provides exercise where the arc of movement is greater than 180 degrees. For example, as shown in FIG. 7 for shoulder extension the pulley continues to resist the movement to attain a greater movement.

Figure 8:
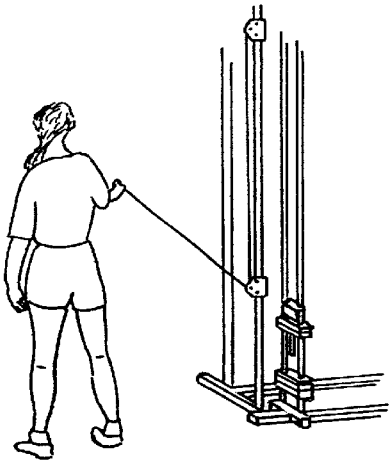
Figure 9:
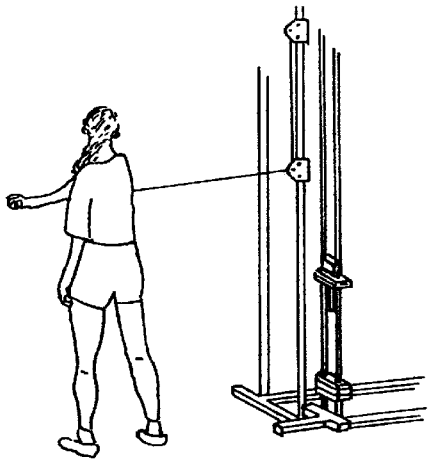
Figure 10:
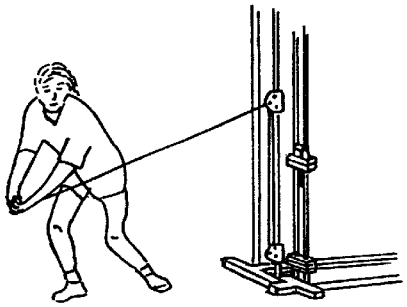
Figure 11:
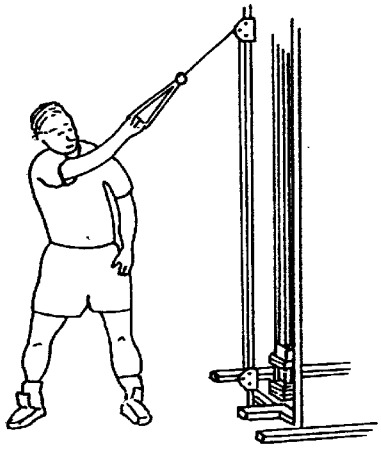
Figure 12:
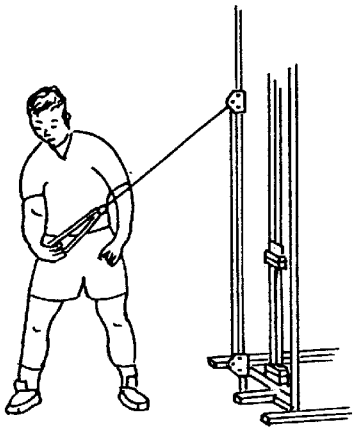
Figure 13:
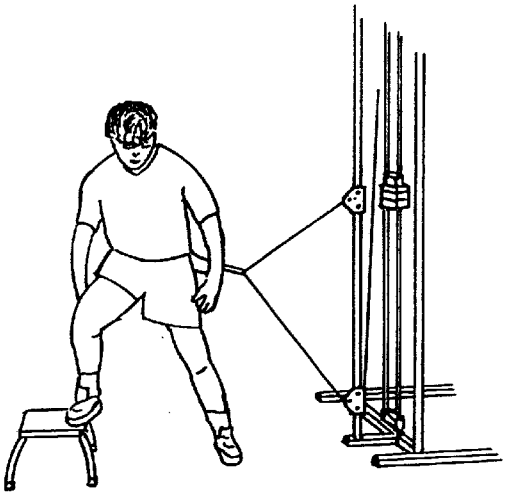
Figure 14:
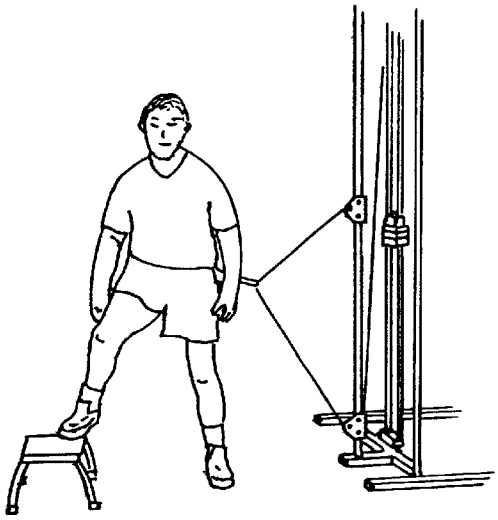
Figure 15:
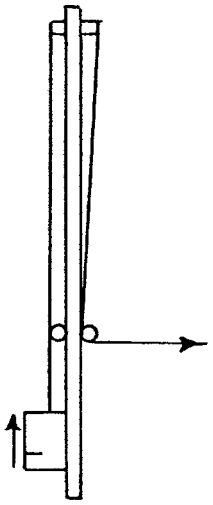
Figure 16:
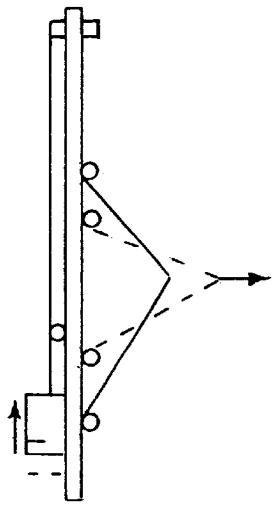
Figure 17:
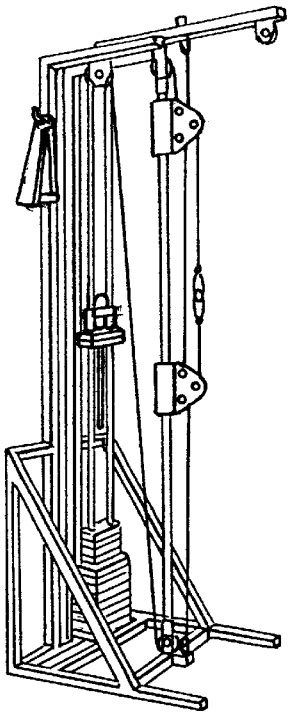

The pulley system of apparatus 10 is superior PNF for diagonals (FIGS. 8 and 9). Most PNF patterns involve large arc movements. In the case where the arm starts behind the body and finishes behind the body as shown in FIG. 10, the pulley block 48 moves downward and keeps the cord 56 at a better angle with the arm. In this way the system of apparatus 10 provides significant resistance all through the larger arc exercises. This system is superior when an increase in resistance with movement is desired.

Standard wall pulleys are frequently used for closed chain movements. This is accomplished by the patient performing side stepping exercise against the pulley system. In this instance the resistance starts with the same force when the exercise movement is completed. However, in some instances, the therapist would prefer to have the resistance increase as the movement is completed and then have the patient hold against the increased resistance. This movement is also possible with the apparatus 10 in the "bow-stringing" method (see FIGS. 13–16). The two pulley blocks 46 and 48 can be set at varying distances. The sections of cord extending from the blocks 46 and 48 become convergent very quickly, thus making the resistance increase quicker.

The apparatus 10 can be used in a multi-resistance trainer all encompassing therapeutic exercise mode, see FIGS. 17–20. In this mode, the apparatus 10 is an all encompassing therapeutic exercise unit that can generate a variety of forces. The Variable Resistance mode matches the physiology of the muscle. This useful in both the clinical field and the field of medical training. This mode allows:

1. PNF three dimensional movements with variable resistance making possible a new range of exercise not previously available.
2. Use in the bow stringing method for resistive closed chain exercises.
3. A wide range of resistance and assistance force options. The type of pulley resistance between the weight stack and the resistance between the cord can be changed. It may be used in the variable mode, the traditional mode or the resistance mode.

The apparatus 10 can also function in a continuously variable position mode (C.V.P.P.). In this mode, the apparatus 10 functions as a continuously variable position pulley system that extends the arc of effective resistance to ¾ of a circle. This also maintains the effectiveness of the resistance cord by continually changing the direction of the resistance cord as the resistance segment moves in an arc. The variable position mode is especially useful in wide sweeping diagonal movements for PNF, late stage lumbar stabilization programs, and rehab training for many sports movements. As shown, the pulley moves to maintain the resistance rope angle with the forearm.

Figure 21:
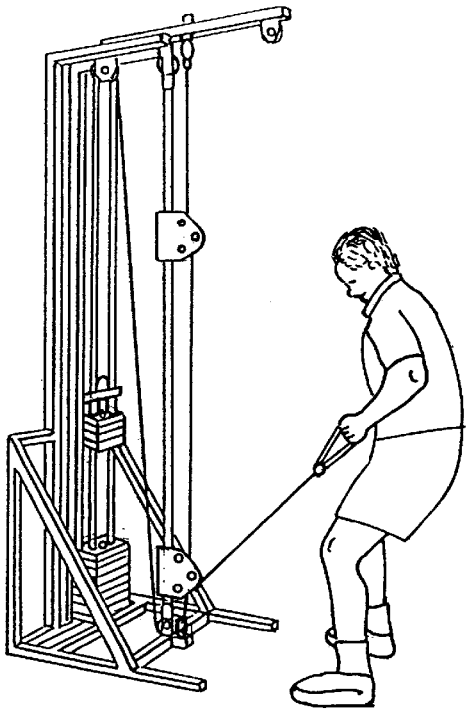
Figure 22:
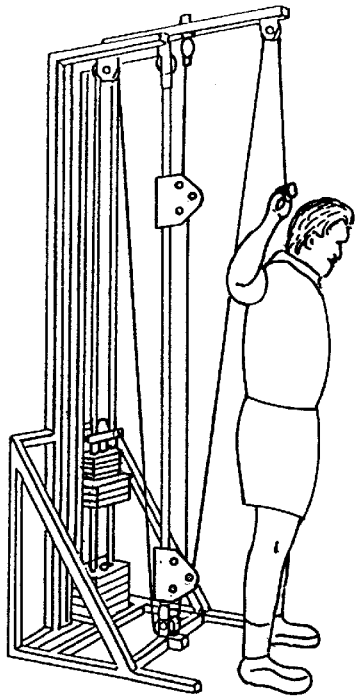
Figure 23:
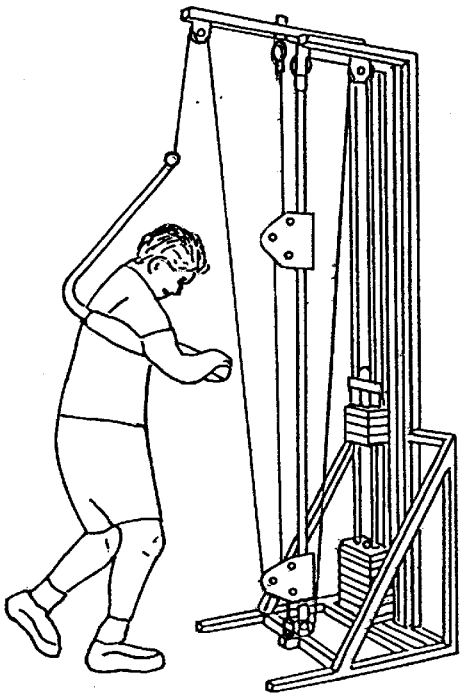

Referring to FIGS. 21–24, the type of pulley system between the weight stack 30 and the final resistance cord can easily be changed. The patient can be working with a fixed pulley system in which the ratio of final resistance cord force to weight stack forces is nearly 1:1, as shown in FIG. 21. The patient is exerting a great deal of effort by back, trunk, leg and arm muscles to lift only half the weight stack. However, when the therapist adds a moveable pulley system before the final resistance cord, the resistance of the weights an be brought down into the "therapeutic range". For example as shown in FIG. 22, the patient is performing a "lat pull-down" exercise lifting nearly ¾ of the weight stack using only the upper extremity muscles. Alternatively, a wide range of the MRT's assistance force capabilities can be used for unloading situations such as early ACL rehabilitation. In this setting, (FIG. 23), the pulley system is fixed so that the weight stack 30 is assisting the patient and little force is exerted. The overhead track bar 20 extends out from the weight stack 30 sufficiently so that the final pulley sheave 24 is directly overhead.

Figure 24:
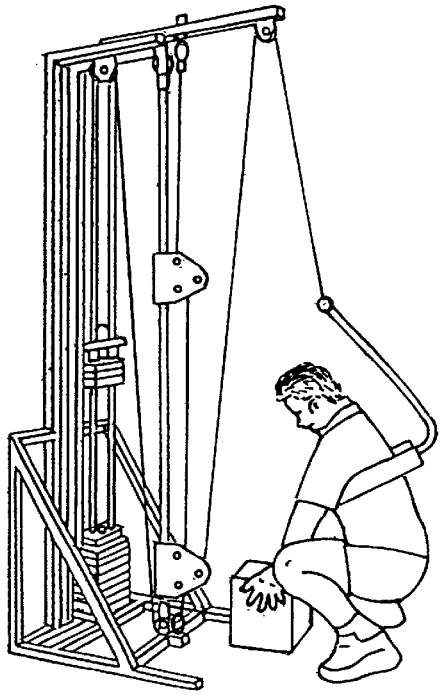
Figure 25:
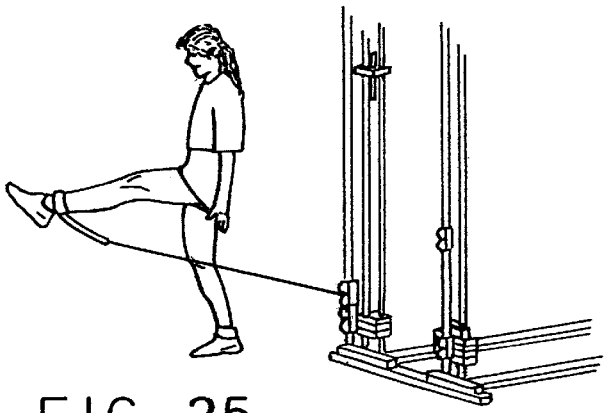
FIGS. 25–30 are diagrammatic views illustrating the various modes of operation for the apparatus of FIG. 4.
Figure 26:
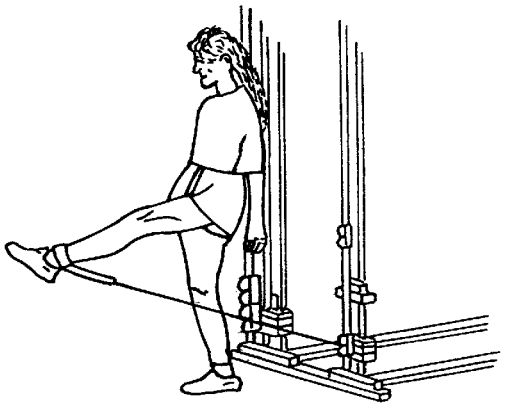

The use of the lifting frame is superior to doing the same exercise with the assistance from the parallel bars in that the patient must provide the lateral and horizontal stabilization while doing the exercise. The use of the frame helps provide proprioceptive training. The same assistance force effect is shown when the apparatus 10 is used during lifting training (FIG. 24).

Figure 4:
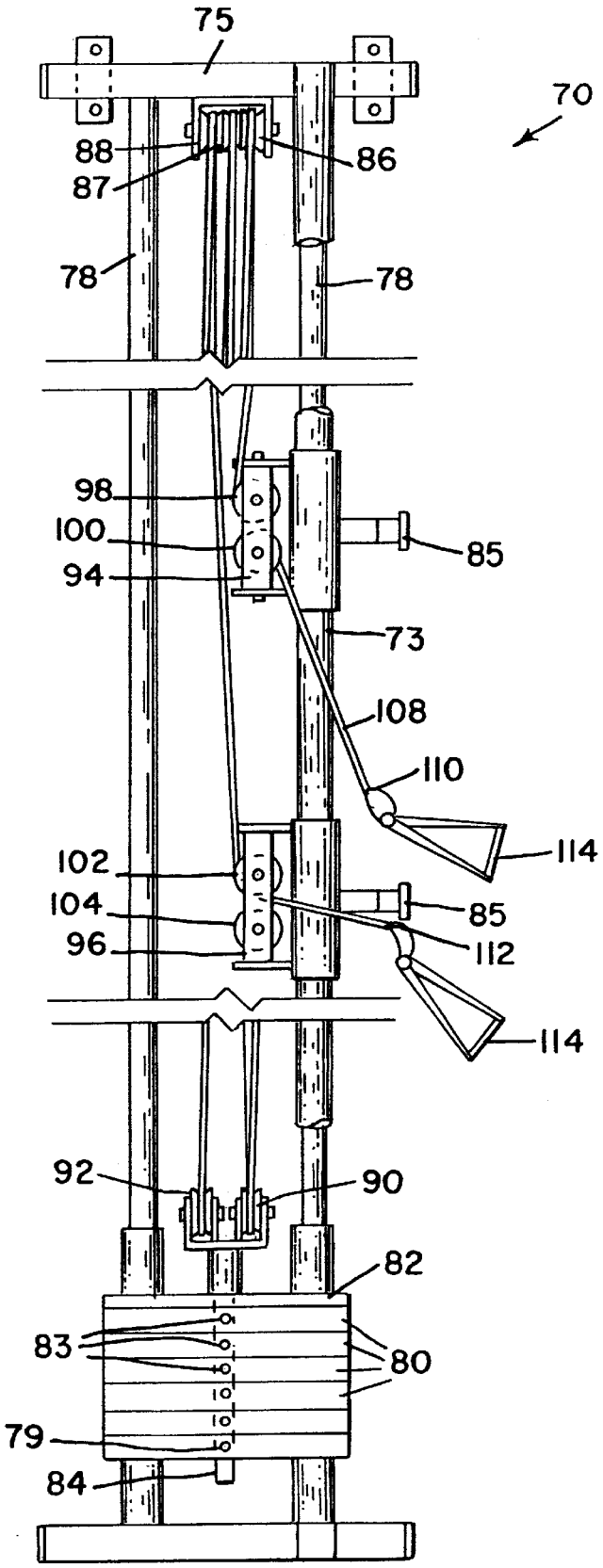
FIG. 4 is a fragmentary side elevational view of a modified therapeutic exercise apparatus.
Figure 5:
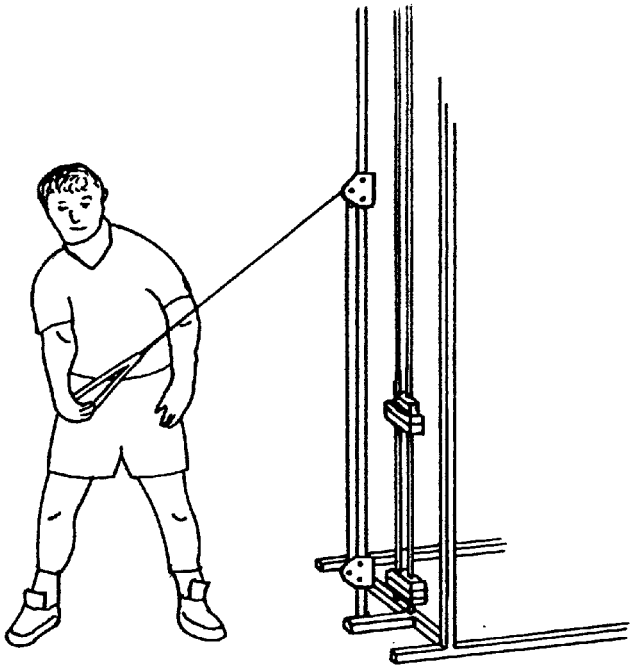
FIGS. 5–24 are diagrammatic views illustrating the various modes of operation for the apparatus of FIGS. 1–3.

Referring to FIG. 4, there is shown a second embodiment of the present invention, generally indicated by the reference numeral 70. The embodiment 70 includes a frame, generally indicated by the reference numeral 72 having a supporting base 74, a forward supporting post 73, and a pair of upper support bars 75.

The frame 72 supports a weight stack assembly, generally indicated by the reference numeral 76. Assembly 76 includes a pair of spaced vertical guide rods 78 extending from the base 74 to the forward upper support bar 75. A plurality of weight bars 80 are slidable mounted on the guide rods 78. An upper block 82 is also slidable mounted on the guide rod 78 and contains a downwardly extending vertical rod 84 which has a plurality of spaced horizontal apertures 79. Each weight bar 80 has a vertical aperture adjacent each end of the weight bar and a central vertical aperture for receiving the vertical rod 84 of the upper block 82. The end apertures enable each weight bar to receive the guide rods 78 for enabling the weight bar to slide vertically on the guide rod. Each weight bar is also provided with a horizontal aperture 83 for receiving a pin. When the weight bars 80 are in the lower stacked position, as shown in FIG. 4, the apertures 79 of the weight bars are aligned with the apertures of the post 84. This enables a locking pin to be inserted through the aperture of a selected weight bar and into the corresponding aperture of the post 84 for enabling the weight bar to be connected to the post 84 when the upper block is raised relative to the guide rods 78. The weight bar 80 which is connected to the post 84 will also be raised along with all of the weight bars located above the selected weight bar. This enables one or more of the weight bars 80 to selectively raised. A pair of sheaves 90 and 92 are rotatable mounted on the upper block 82. Three sheaves 86, 87, and 88 are mounted for rotation on the forward support bar 75. An upper pulley block 94 and a lower pulley block 96 are each slidable mounted on the forward support post 73. The forward support post 73 has a plurality of spaced horizontal apertures. Each pulley block 94 and 96 has a horizontal aperture which can be selectively aligned with any of the apertures on the post 73. Each pulley block 94 and 96 can be selectively locked at any vertical position along the post 73 by aligning the aperture of the pulley block with a selected aperture in the post 73 and inserting a locking pin 85 through the aligned apertures for maintaining the pulley blocks in any selected vertical position. The upper pulley block 94 has a pair of sheaves 98 and 100 rotatable mounted within the pulley block. The lower pulley block 96 has a pair of sheaves 102 and 104 rotatable mounted within the pulley block. A cord 108 has a first end 110 and a second end 112. Each end 110 and 112 can be connected to any conventional gripping element, such as the handles 114, shown in FIG. 3. The cord 108 extends from the first end 110 into the upper pulley block 94 and between the sheaves 98 and 100. The cord 108 then extends upwardly to the sheave 86 and downwardly to the sheave 90. The cord then extends upwardly from the sheave 90 to the sheave 87 and downwardly to the sheave 92. From the sheave 92, the cord 108 extends upwardly to the sheave 88 and then downwardly to the lower pulley block 96. The cord 108 enters the lower pulley block 96 and between the sheaves 102 and 103 and forwardly to the end 112, as shown in FIG. 4.

The second embodiment of this invention referred to generally with the numeral 70 in FIG. 4, differs from embodiment 10 by having a plurality of fixed positions on the forward post 73 and by having an additional pulley 87 which serves to reduce the force of cords 110 and 112 necessary to lift the weight or weights on the weight stack 80. This enables the therapist to fix the pulley blocks 96 and 98 at intermediate positions on the forward post 73 that are best suited for patient stature exercise. In addition, the reduced lifting force on cords 110 and 112 make the pulley system 70 useful to patients who have very week muscles or who are recovering from peripheral nerve injury. The minimum cord force or resistance to pull on the pulley system 70 is ½ pound, making it well suited for treatment in acute orthopedic problems.

Although the forward post illustrated in the accompanying figures for both embodiments is shown in a vertical orientation, the above description of the biochemical advantage of certain exercises does not prohibit the forward post 44 (or 73) from being oriented horizontally or at any angle in between vertical and horizontal. Such a reorientation of the forward post allows the therapist to accommodate a wider variety of controlled and tailored exercises using the pulley movement advantage of these systems.

Referring to FIGS. 4 and 25–30, the pulley system of apparatus 70 allows the therapist the freedom to use pulley resistance with very acute orthopedic problems. By passing the cord through multiple sheaves, the ratios of the weight force of the stack 76 to the resistance cored 108 force is reduced. This results in a pulley system having a minimum resistance of ½ lb. making it within the therapeutic range for such treatments as a tendon in the late proliferation to early remedying phase of collagen healing. Using this resistance is both comfortable, safe and encouraging to the patient with these types of problems. This system can also be used for patients with very weak muscles such as those recovering from peripheral nerve injury. A superior product when the therapist is working with a patient who has a very acute problem such as rehabilitating an injured or surgically repaired tendon.

An important feature of the apparatus 70 is its dampening effects on the ballistic found in the regular pulley systems making it very useful for muscle power training. The system eliminates the normal slackening of the rope with pulleys during high velocity sweeping movements such as those found in kicking or throwing. The pulley system 70 is a multiple axis system with the ratio of movement of the cord to movement of weight stack with a reduced ratio. Therefore, it is able to incorporate a large number of sports movement.

One of the main applications of the apparatus 70 is to help patients gain muscle endurance with light weights. One of the most common muscle groups trained for endurance is the scapular retractors. The pulley system 70 has two rope ends that can be arranged so that one is just above the other. This arrangement allows the apparatus to pull toward the center. The regular pulleys for this type of exercise would require two pulley weight stacks. Yet the apparatus 70 allows the therapist to resist scapular retractors with only one weight stack.

Figure 27:
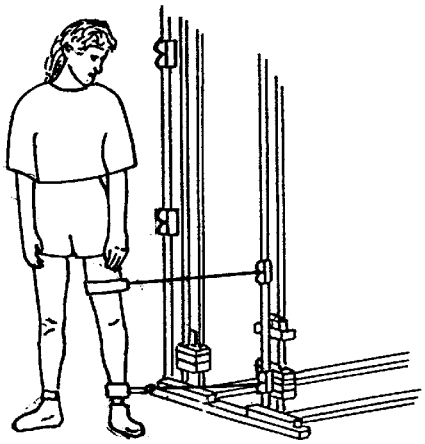
Figure 28:
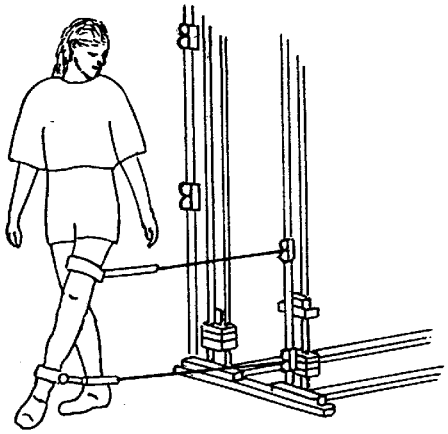
Figure 29:
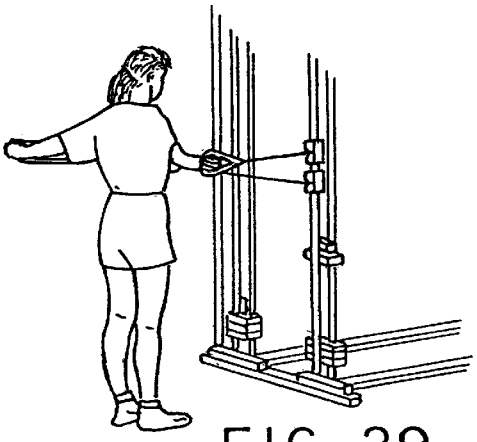
Figure 30:
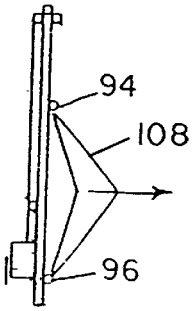

When therapists are helping patients recover muscle power, they are often concerned about injury to the intermediate joint. For example, if the resistance is applied to the foot so that the patient can train the movement necessary for kicking, the knee is the intermediate joint. The apparatus 70 with its two rope ends can be adjusted so that two rope ends can resist the movement. As shown in FIGS. 27 and 28, one which is connected to one cord end could be positioned at the ankle and the other strap which is connected to another cord end is located at the knee for protection.

What is claimed is:

1. A therapeutic exercise apparatus comprising:

(a) a supporting frame having a forward end and a rearward end;

(b) a weight supported on said supporting frame adjacent said rearward end for vertical movement from a lower resting position to an upper position, said weight having at least one weight sheave rotatably mounted on said weight;

(c) a vertical post fixed to said supporting frame adjacent said forward end, said vertical post having an upper end and a lower end;

(d) an upper pulley block slidably mounted on said post, said upper pulley block having at least one sheave rotatably mounted on said upper pulley block;

(e) a lower pulley block slidably mounted on said post below said upper pulley block, said lower pulley block having at least one sheave rotatably mounted on said lower pulley block;

(f) a first locking means for releasably locking said upper pulley block in a fixed position on said vertical post adjacent the upper end of said post;

(g) a second locking means for releasably locking said lower pulley block in a fixed position on said vertical post adjacent the lower end of said post;

(h) a pulley apparatus comprising a plurality of guide sheaves mounted on said frame and cord means trained around said guide sheaves, said weight sheave and the sheave on each of said upper and lower pulley blocks, said cord means having a first cord end extending forwardly from said upper pulley block and a second cord end extending forwardly from said lower pulley block;

(i) an upper fixture connected to said first cord end for functioning as an anchor to prevent said first cord end from being pulled rearwardly from said first pulley block,said upper fixture being adapted to be connected to a handle; and (j) a lower fixture connected to said second cord end for functioning as an anchor to prevent said second cord end from being pulled rearwardly from said second pulley block, said lower fixture being and adapted to be connected to a handle so that when said weight is at said lower resting position and one of said upper and lower pulley blocks is in a fixed position on said vertical post to constitute a fixed pulley block and the other of said upper and lower pulley blocks is free to slide on said vertical post to constitute a free pulley block, the pulling of the corresponding one of said first and second cord ends extending from said free pulley block forwardly from said frame causes said free pulley block to slide on said vertical post toward said fixed pulley block and causes said weight to be lifted from said lower resting position toward said upper position.

2. The therapeutic exercise apparatus as recited in claim 1, wherein said upper pulley block has an upper sheave and a first forward sheave, said lower pulley block has an upper sheave and a second forward sheave and said pulley apparatus comprises:

(a) a forward cord having said first and second cord ends and being trained around said first and second forward sheaves;

(b) an upper forward guide pulley rotatably mounted on said frame above said upper pulley block;

(c) a lower forward guide pulley rotatably mounted on said frame below said lower pulley block;

(d) a first rearward guide pulley rotatably mounted on said frame above said weight;

(e) a second rearward guide pulley rotatably mounted on said frame above said weight; and (f) a rearward cord having an upper end fixed to said frame above said upper pulley block and a lower end fixed to said frame below said lower pulley block, said rearward cord extending downwardly from said upper end to said upper sheave, around said upper sheave, upwardly to said upper forward guide pulley, rearwardly to said first rearward guide pulley, downwardly to said weight sheave, upwardly to said second rearward guide pulley, downwardly to said lower forward guide pulley, upwardly to said lower sheave, around said lower sheave and downwardly to said lower end.

3. The therapeutic exercise apparatus as recited in claim 2, wherein said upper pulley block has lower idler pulley, said lower pulley block has an upper idler pulley and said first cord extends between said lower idler pulley and said first forward sheave and between said upper idler pulley and said second forward pulley.

4. The therapeutic exercise apparatus as recited in claim 1, wherein said first locking means comprises an upper aperture adjacent the upper end of said vertical post, a first aperture in said upper pulley block which is horizontally aligned with said upper aperture when said upper pulley block is in its fixed position on said post and a pin which is insertable through said first aperture and said upper aperture and, wherein said second locking means comprises an lower aperture adjacent the lower end of said vertical post, a second aperture in said lower pulley block which is horizontally aligned with said lower aperture when said lower pulley block is in its fixed position on said post and a pin which is insertable through said second aperture and said lower aperture.

5. The therapeutic exercise apparatus as recited in claim 1, further comprising:

(a) an upper support bar fixed to said frame and extending forwardly from said frame, said support bar having a forward end;

(b) a forward supporting pulley mounted for rotation on the forward end of said support bar; and (c) a third cord having a first end which is adaptable to be connected to a conventional grasping device and a second end which is adaptable to be connected to the second end of said second cord, said third cord extending over said forward supporting pulley.

6. A therapeutic exercise apparatus comprising:

(a) a supporting frame having a forward end and a rearward end;

(b) a weight supported on said supporting frame adjacent said rearward end for vertical movement from a lower resting position to an upper position, said weight having at least one weight sheave rotatably mounted on said weight;

(c) a vertical post fixed to said supporting frame adjacent said forward end;

(d) an upper pulley block slidably mounted on said post, said upper pulley block having at least one sheave rotatably mounted on said upper pulley block;

(e) a lower pulley block slidably mounted on said post below said upper pulley block, said lower pulley block having at least one sheave rotatably mounted on said lower pulley block;

(f) an upper handle;

(g) a lower handle;

(h) locking means for releasably locking each of said upper pulley block and said lower pulley block in a plurality of vertical positions on said guide post; and (i) a pulley apparatus comprising a plurality of guide sheaves mounted on said frame and at least one cord connected to said upper and lower handles and trained around said guide sheaves and each of the sheaves on said weight, said upper pulley block and said lower pulley block so that when each of said upper and lower pulley blocks is in a fixed position on said guide post, the pulling of either or both of said upper and lower handles forwardly from said upper and lower pulley blocks causes said weight to be lifted from said lower resting position toward said upper position.

7. The therapeutic exercise apparatus as recited in claim 6, wherein said upper pulley block has a first upper sheave and a first lower sheave, said lower pulley block has a second upper sheave and a second lower sheave, said weight has a first weight sheave and a second weight sheave and, wherein said pulley apparatus comprises:

(a) a first guide pulley mounted for rotation on said frame above said weight and said upper pulley block;

(b) a second guide pulley mounted on said frame above said weight and said upper pulley block;

(c) a third guide pulley mounted on said frame above said weight and said upper pulley block; and (d) a cord having a first end connected to said first handle and a second end connected to said second handle, said cord extending from first handle between said first upper and lower sheaves, upwardly to said first guide pulley, downwardly to said first weight sheave, upwardly to said second guide pulley, downwardly to said second weight sheave, upwardly to said third guide pulley, downwardly to said lower pulley block, and forwardly between said second upper sheave and said second lower sheave to said second handle.

* * * * *